United States Patent [19]

Meek et al.

[11] Patent Number: 4,687,380

[45] Date of Patent: Aug. 18, 1987

[54] TOWER STRUCTURE AND METHODS OF FABRICATING SUCH A STRUCTURE

[75] Inventors: Jan Meek, Gouda; Kees Willemse, Leiden, both of Netherlands

[73] Assignee: Heerema Engineering Service BV, Leiden, Netherlands

[21] Appl. No.: 868,689

[22] Filed: May 30, 1986

Related U.S. Application Data

[63] Continuation-in-part of Ser. No. 590,145, Mar. 16, 1984, abandoned.

[30] Foreign Application Priority Data

Mar. 18, 1983 [GB] United Kingdom ..... 8307640

[51] Int. Cl.[4] ..... E02D 17/00

[52] U.S. Cl. ..... 405/204; 405/203; 405/224

[58] Field of Search ..... 405/203, 204, 195, 205, 405/208, 206, 207, 224, 227, 225; 175/5-7; 248/524

[56] References Cited

U.S. PATENT DOCUMENTS

| | | | |
|---|---|---|---|
| Re. 30,825 | 12/1981 | Guy et al. | 405/204 |
| 2,637,978 | 5/1953 | Evans et al. | 405/224 X |
| 2,849,202 | 8/1958 | McCombs | 248/524 X |
| 2,901,890 | 9/1959 | Hutchison | 405/224 |
| 3,380,520 | 4/1968 | Pease | 405/224 X |
| 3,387,459 | 6/1968 | Manning | 175/7 X |
| 3,524,322 | 8/1970 | Pogonowski | 405/227 |
| 3,546,885 | 12/1970 | Pogonowski | 405/227 |
| 3,572,044 | 3/1971 | Pogonowski | 405/227 X |
| 3,638,436 | 2/1972 | Pogonowski | 405/227 |
| 3,839,872 | 10/1974 | Loire | 405/225 |
| 4,109,476 | 8/1978 | Gracia | 405/203 X |
| 4,553,878 | 11/1985 | Willemse et al. | 405/203 |

FOREIGN PATENT DOCUMENTS

| | | | |
|---|---|---|---|
| 2270390 | 12/1975 | France | 405/207 |
| 2096673 | 10/1982 | United Kingdom | 405/204 |

*Primary Examiner*—Dennis L. Taylor

*Attorney, Agent, or Firm*—Fulwider, Patton, Rieber, Lee & Utecht

[57] ABSTRACT

A tower structure having a central column, three support legs and a base structure which can be anchored to the sea bed by means of piles. The legs and base structure are constructed as an integral preformed base unit with a sleeve attached to the upper ends of the legs.

The column is slidingly engaged within the sleeve of the base unit. A rigid connection is made between the column and the sleeve. In the erected structure, the primary load of the column is transmitted through the column and sleeve connection via the base unit to the sea bed.

14 Claims, 12 Drawing Figures

TOWER STRUCTURE AND METHODS OF FABRICATING SUCH A STRUCTURE

This application is a continuation-in-part of our application Ser. No. 590,145 filed Mar. 16, 1984, and now abandoned.

FIELD OF THE INVENTION

This invention relates to an offshore tower structure of the kind adapted to be erected in a body of water and comprising:

a central column, a base unit to support the column on the seabed and to which the column can be attached offshore, a platform to be attached to the upper end of the column and be supported thereby, the column being able to carry conductors, risers and the like between the seabed and the platform, the base unit comprising a base structure to rest on and be anchorable to the seabed and a plurality of legs which are attachable at their lower ends to the base structure at horizontally spaced locations and which are attachable at their upper ends to the column at a position intermediate the ends of the column, The at legs extending upwardly and inwardly from the base structure to the column.

BACKGROUND TO THE INVENTION

A structure of this kind is known from HENDERSON in Fr No. 2270390. The HENDERSON structure is erected offshore by installing the column and legs in step-by-step fashion onto a pre-installed base structure. A pivotal connection is made between the legs and the base structure to enable the legs to be swung into position relative to the column. The legs are then attached to the column by a grouted connection. One of the difficulties in the HENDERSON structure is the pivotal connection of the legs to the base structure. HENDERSON proposes for this a pin-type universal coupling. Bearing in mind the size of the components of the HENDERSON structure and the fact that the connection has to be made at the bottom of the ocean, the HENDERSON proposal is in this respect considered to be unrealistic in practice. Another difficulty is that in the HENDERSON structure the weight of the column is not fully supported by the legs. Even after the grouted connection has been made, some of the weight of the column in HENDERSON has to be borne by the base structure. The base structure must therefore be made sufficiently massive to take this weight. The structure developed by UITTENBOGAARD et al and shown in GB No. 2096673 offers neat solutions to these problems. UITTENPOGAARD concerns a structure which is of the same kind which is erected offshore by installing the column and legs in step-by-step fashion onto a pre-installed base structure. The UITTENBOGAARD base structure has upwardly facing wedge-shaped recesses which enables the pivotal connection of the legs to be made by simple lowering of the legs vertically into the recesses. At ocean depths of up to 450 meters, and with correspondingly sized components parts, this is consideraly easier to achieve than HENDERSON'S proposed connections. Furthermore, UITTENBOGAARD provides a nodal structure integrally on the column with downwardly extending projections for the legs. The column is lowered to a first depth and the legs are swung into position immediately below the column projections. Then the column is lowered further to a second depth so that the legs are received and located in the column projections. The connection is then made between the column and legs. By this, UITTENBOGAARD is able to ensure that the weight of the column is fully supported by the legs.

The present application is made by the same Assignee as that of UITTENBOGAARD et al. The development leading to the present application is primarily concerned with shallower water structures than that for which the UITTENBOGAARD structure was developed. Thus the present invention offers a useful alternative to the UITTENBOGAARD structure for installations where the water depth and conditions allow.

The present invention is based on the idea of fabricating an offshore structure in essentially only two pieces, a pre-formed base unit, which can be anchored on the sea bed, and a column. The base unit is provided with a sleeve through which the column can be slidingly received. The structure is erected by slidingly engaging the column with the sleeve of the base unit. This can be either in horizontal mode, parallel to the surface of the water, or in vertical mode, by lowering the column vertically with respect to the base unit. The column is attached to the base unit by means of a rigid connection between the column and sleeve. The sleeve is of sufficient dimensions that when the rigid connection is made between the column and sleeve, the sleeve is able to accept the primary load of the column, such load thus being transmitted through the legs and base structure of the base unit to the sea bed. A structure having the strength advantages of the UITTENBOGAARD structure is thus provided, but with the additional advantage that its fabrication and installation is greatly simplified.

BRIEF SUMMARY OF THE INVENTION

The present invention provides an offshore tower structure of the kind as defined above and in which the base unit is constructed as an integral preformed structure with a column receiving sleeve attached to the upper ends of the legs and with means for locating the lower end of the column laterally with respect to the base structure, the column being connectable to the base unit by slidingly engaging the column within the sleeve of the base unit, locating the lower end of the column by the locating means and attaching the column to the base unit by rigid connection means between the column and the sleeve, the arrangement being such that in the assembled structure the primary load transfer between the column and the sea bed is through the column and sleeve connection, to the legs, to the base structure and hence to the sea bed.

A structure which appears to bear a superficial resemblance to the present structure is seen in U.S. Pat. No. 3,524,322 to POGONOWSKI. However, there is no suggestion that the legs in the POGONOWSKI structure take any vertical load off the column. POGONOWSKI emphasises that the legs are for providing lateral support for the column. Further evidence of the fact that POGONOWSKI is not concerned with the primary load transfer between the column and base structure through the legs is seen in FIG. 1 where the column is of massive size compared with the legs. Furthermore, the column actually extends into the sea bed, in POGONOWSKI, thus directly transferring the column weight to the sea bed. There is nothing in POGONOWSKI to suggest constructing a base unit comprising the legs and the base structure as an integral preformed structure.

A specific example of a fixed tower structure, in this case a transport tanker loading tower, embodying the invention and methods of fabricating such tower will now be described with reference to the accompanying drawings in which:

FIG. 7 shows the piles driven in,

Figure 8A:
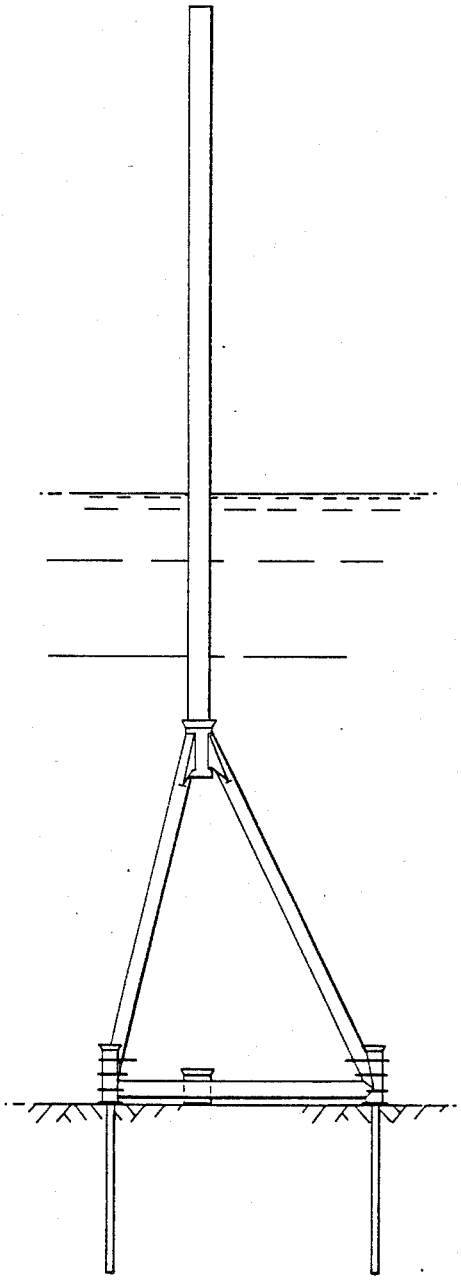
Figure 8B:
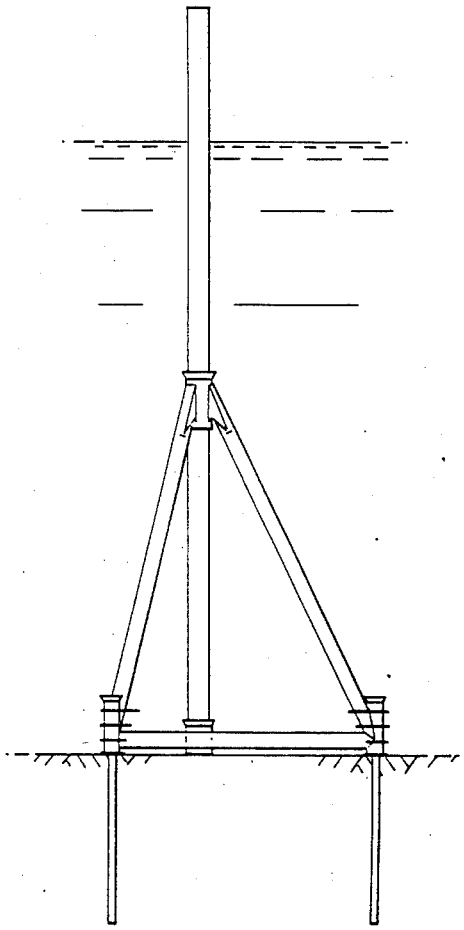
Figures 9A, 9B, 9C:
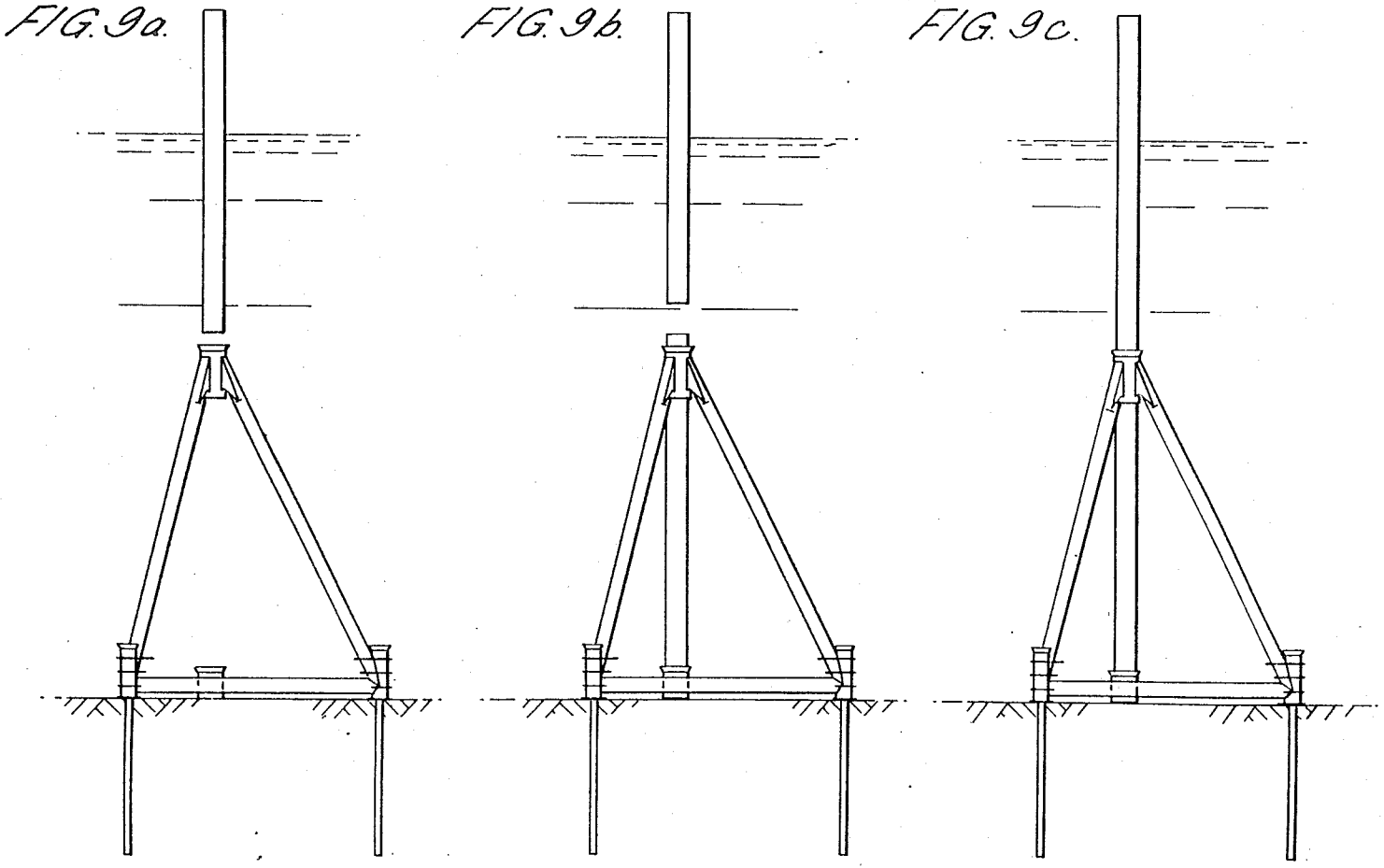

FIGS. 8*a* and 8*b* show the column being lowered vertically into the unit comprising the legs and the base structure, and FIGS. 9*a*, 9*b* and 9*c* show the column being lowered in sections vertically into the unit comprising the legs and the base structure.

Figure 2:
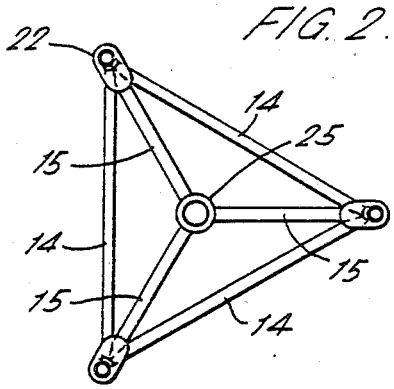
FIG. 2 is a section on the line 2—2 in FIG. 1.

The structure of this example comprises a central column 10 and a bracing unit which consists of three support legs 11 and a base structure 12. The base structure comprises three struts 14 and three radial struts 15 as can be seen from FIG. 2.

The central column, the legs and struts are in this case all made of mild steel which is cold rolled and welded to form large tubular members, although of course other materials, such as high tensile steel, and other fabrication techniques could equally well be used.

The structure is designed to be situated in water with a depth of 105 meters with the apex of the legs 11 being at a depth of 25 meters and a loading platform 16 attached to the top of the column at a height of 25 meters above the water level. Although in this example a transport tanker loading platform 16 is illustrated any other assembly could be located at the top of the column.

The tower structure is built by first building the unit comprising the legs and the base structure and then attaching the central column.

Figure 3:
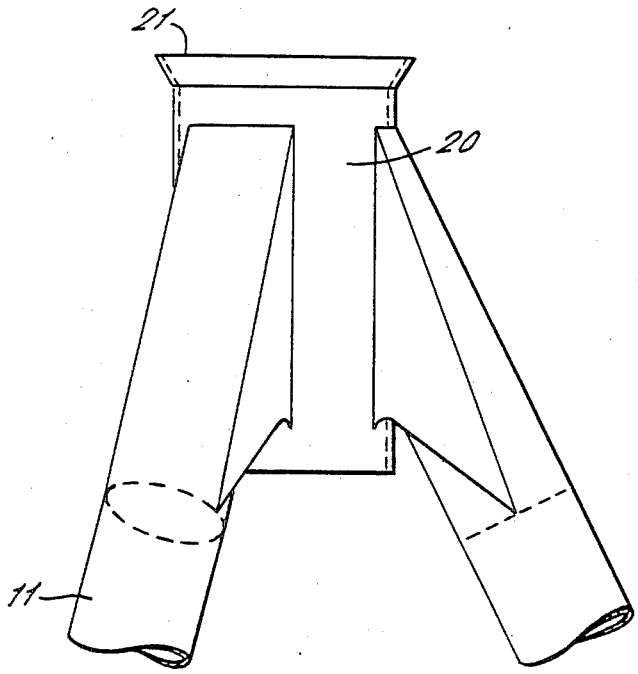
FIG. 3 is a side view showing a possible connection of the support legs to the upper sleeve.

The unit of the legs and base structure is an all welded construction and the legs are welded at their upper ends to an upper sleeve 20 details of which are shown in FIG. 3. The inside of the sleeve is shaped to suit the central column and is provided with a funnel 21 at its upper end for serving as a guide for receiving the central column as will be described later.

The three legs 11 are welded to the sleeve 20 and it will be seen that the connection between the legs and the sleeve can be made by means of bracket means as described in our earlier Pat. Spe. No. 8,212,699. Of course no internal stiffening is provided within the sleeve but the joining of the legs to the sleeve can be exactly as described in that earlier application.

In this particular embodiment, the structure has three support legs, but it will be appreciated that there may only be two such legs, arranged at right angles to each other, for supporting the central column.

The lower ends of the sleeves are welded to corner members 22 each of which comprises a further sleeve 23, also with a funnel 24, for the reception of piles.

The struts 14 and 15 are welded to the corner members 22 and the struts 15 are also welded to a central lower sleeve 25. The lower sleeve 25 is provided with an upper funnel 26 and is also designed to receive the column.

An important feature of the unit is that it is a self-supporting assembly and the upper sleeve 20 and its connection to the upper ends of the legs 11 is such that the primary load transfer between the legs and the column is essentially via the sleeve 20.

Figure 4:
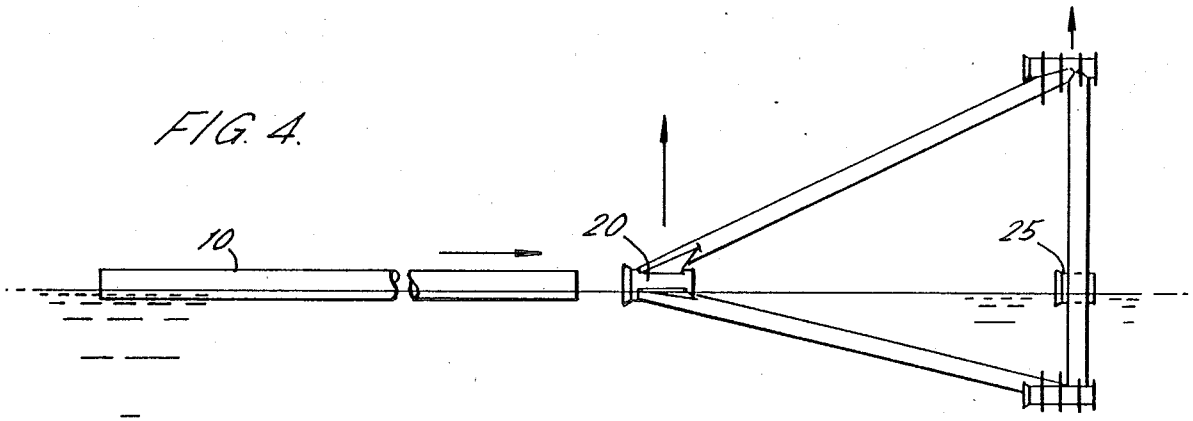
FIG. 4 shows the central column being floated into the unit comprising the legs and the base structure.

In a first method of fabrication, as can be seen from FIG. 4, the central column 10 is located in position with regard to the unit by floating the column 10 on the surface of water in a sheltered location and holding the unit with the sleeves 20 and 25 along the waters surface. The can be done by the use of suitable cranes.

Figure 5:
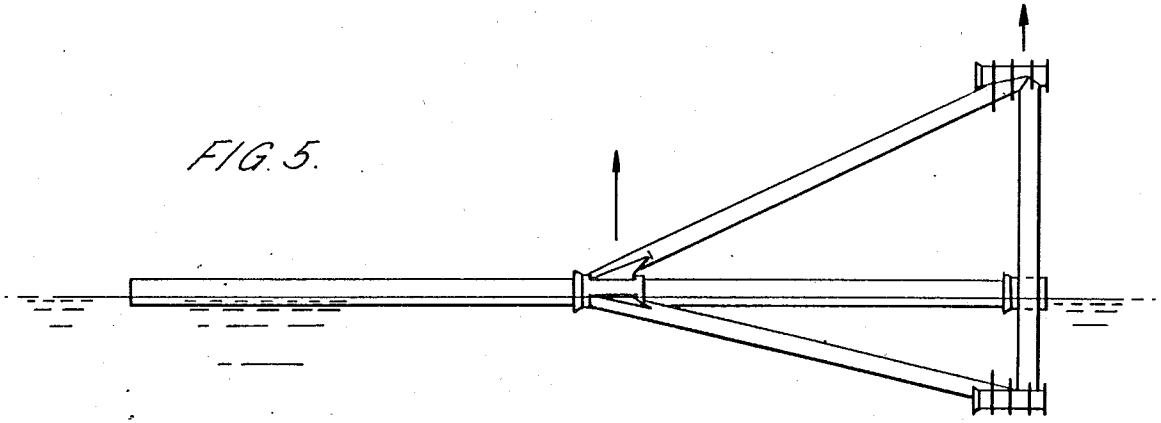
FIG. 5 shows a column positioned within the legs and base structure.

The central column 10 is then floated into the sleeves as shown in FIG. 5 and a rigid connection made between the column and sleeves. The rigid connection can be made by pumping grout into the spaces between the sleeves and the column, or alternatively, the rigid connection can be made by bolting or welding.

Figure 6:
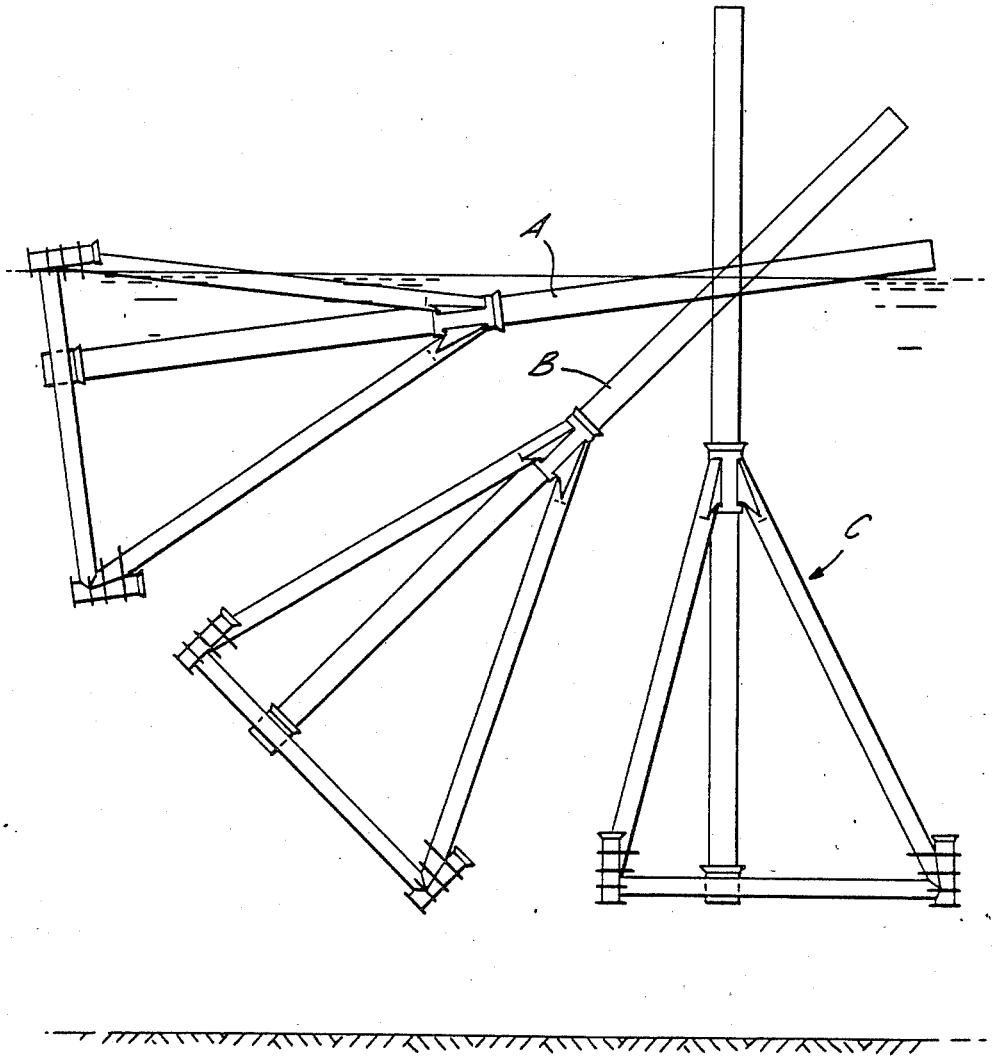
FIG. 6 shows the completed tower being lowered into position on the sea bed.

The whole structure is then towed to its desired location as shown in position A in FIG. 6 and is then slowly ballasted to position B and to its eventual position C.

Figure 7:
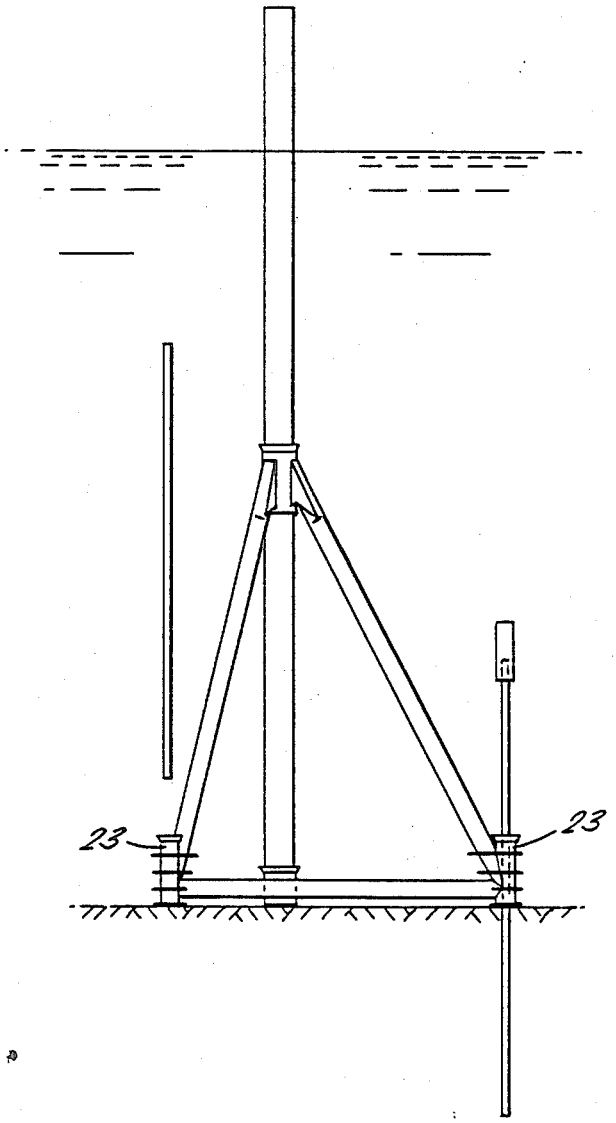

Piles are then driven into the sea bed through the sleeves 23 as shown in FIG. 7 to locate and secure the structure in position. Alternatively, the structure can be anchored in position by other means such as gravity fixing.

Figure 1:
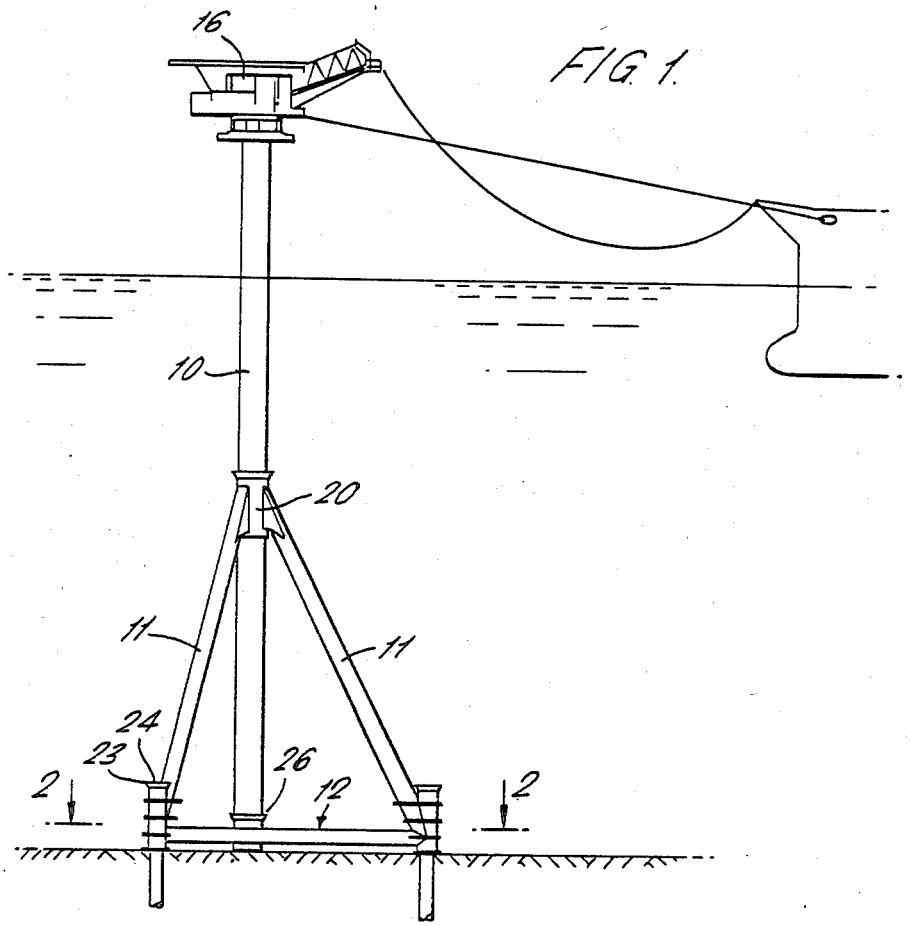
FIG. 1 is a vertical view of the tower after installation.

Finally the platform is installed on top of the column providing the structure shown in FIG. 1.

In an alternative method of fabrication, as can be seen from FIGS. 8*a* and 8*b*, the unit consisting of the legs and base structure is pre-installed on the sea bed. The unit can be anchored in position by use of piles or other known techniques, such as gravity fixing. The column is then located in position with regard to the unit by lowering the column vertically through the sleeves. This can be conveniently done by the use of a suitable crane. A rigid connection is then made between the column and sleeves. The rigid connection can be made by pumping grout into the spaces between the column and sleeves. Alternatively the rigid connection may be made by bolting or welding. Finally, the platform is installed on top of the column providing the structure shown in FIG. 1.

A further alternative method of fabrication can be seen in FIGS. 9*a*, 9*b* and 9*c*. The unit comprising the legs and base structure is pre-installed on the sea bed in similar manner to the method of FIGS. 8*a* and 8*b*. Here, however, the column is provided in two sections. The first section is located in position with regard to the unit by lowering the section vertically through the sleeves. A suitable crane can be used for this. A rigid connection is then made between the column and sleeves using grouting, bolting or welding. The second column section is then fixed to the first column section. The column sections may be fixed together by means of a male/female interfitting connection. The connection may additionally include grouting, bolting or welding. Finally the platform is installed on top of the column providing the structure shown in FIG. 1.

It will be seen that the invention provides a very simple yet stable structure which can be fabricated very easily.

We claim:

1. An offshore tower structure of the kind adapted to be erected in a body of water and comprising.

a central column, a base unit to support the column on the sea bed and to which the column can be attached offshore, a platform to be attached to the upper end of the column and be supported thereby, the column being able to carry conductors, risers and the like between the sea bed and the platform, the base unit comprising a base structure to rest on and be anchorable to the sea bed and a plurality of legs which are attachable at their lower ends to the base structure at horizontally spaced locations and which are attachable at their upper ends to the column at a position intermediate the ends of the column, the legs extending upwardly and inwardly from the base structure to the column, wherein the base unit is constructed as an integral preformed structure with a column receiving sleeve attached to the upper ends of the legs and with means for locating the lower end of the column laterally with respect to the base structure, the column being connectable to the base unit by slidingly engaging the column within the sleeve of the base unit, locating the lower end of the column by the locating means and attaching the column to the base unit by rigid connection means between the column and the sleeve, the arrangement being such that in the assembled structure the primary load transfer between the column and the sea bed is through the column and sleeve connection, to the legs, to the base structure and hence to the sea bed.

2. A tower structure as claimed in claim 1 wherein the base unit has three legs.

3. A tower structure as claimed in claim 1 wherein the locating means of the base unit comprises a further column receiving sleeve which is axially aligned with the first mentioned sleeve and which slidingly receives the lower end of the column.

4. A tower structure as claimed in claim 1 wherein the base unit is provided with at least one sleeve adjacent the lower end of each leg and each said sleeve is designed to receive a pile for anchoring the base structure on the sea bed.

5. A tower structure as claimed in claim 1 wherein the rigid connection means between the column and the sleeve is made by interposing grout between the column and sleeve.

6. A tower structure as claimed in claim 1 wherein the rigid connection means between the column and the sleeve is made by welding or bolting.

7. A tower structure as claimed in claim 1 wherein a rigid connection is made between the column and the column locating means of the base unit.

8. A tower structure as claimed in claim 7 wherein said rigid connection is made by grouting, welding or bolting.

9. A method of fabricating an offshore tower structure and erecting such structure in a body of water, the structure comprising a central column, a base unit to support the column on the sea bed and to which the column can be attached offshore, a platform to be attached to the upper end of the column and be supported thereby, the column being able to carry conductors, risers and the like between the sea bed and the platform.

the base unit comprising a base structure to rest on and be anchorable to the sea bed and a plurality of legs which are attachable at their lower ends to the base structure at horizontally spaced locations and which are attachable at their upper ends to the column at a position intermediate the ends of the column, the legs extending upwardly and inwardly from the base structure to the column, the method including the steps of constructing the base unit as an integral preformed structure with a column receiving sleeve attached to the upper ends of the legs and with means for locating the lower end of the column laterally with respect to the base structure, floating the column horizontally through the column receiving sleeve of the base unit while the base unit is supported with the axis of the column receiving sleeve parallel to the surface of the water, locating the lower end of the column with respect to the base structure by the locating means, attaching the column to the base unit by rigidly connecting the column to the sleeve, rotating the assembled column and base unit and lowering it towards the sea bed until the base structure rests on the sea bed, and securing the base structure to the sea bed.

10. A method as claimed in claim 9 wherein the rigid connection of the column to the column receiving sleeve is made by grouting.

11. A method as claimed in claim 9 wherein the rigid connection of the column to the column receiving sleeve is made by welding or bolting.

12. A method as claimed in claim 9 wherein the base structure is formed with at least one sleeve adjacent the lower end of each leg and the base structure is secured on the sea bed by means of piles driven through said sleeve.

13. A method of fabricating an offshore tower structure and erecting such structure in a body of water, the structure comprising a central column, a base unit to support the column on the sea bed and to which the column can be attached offshore, a platform to be attached to the upper end of the column and be supported thereby, the column being able to carry conductors, risers and the like between the sea bed and the platform, the base unit comprising a base structure to rest on and be anchorable to the sea bed and a plurality of legs which are attachable at their lower ends to the base structure at horizontally spaced locations and which are attachable at their upper ends to the column at a position intermediate the ends of the column, the legs extending upwardly and inwardly from the base structure to the column, the method including the steps of constructing the base unit as an integral preformed structure with a column receiving sleeve attached to the upper ends of the legs and with means for locating the lower end of the column laterally with respect to the base structure, lowering the base unit towards the sea bed until the base structure rests on the sea bed, securing the base structure to the sea bed, lowering the column vertically through the column receiving sleeve of the base unit, locating the lower end of the column by the locating means, and attaching the column to the base unit by rigidly connecting the column to the sleeve.

14. A method as claimed in claim 13 wherein the column is provided in two sections and the method includes the steps of lowering the first column section vertically through the column receiving sleeve of the base unit, locating the lower end of the first column section by the locating means, attaching the first column section to the base unit by rigidly connecting the first column section to the sleeve, lowering the second column section vertically with engagement with the first column section, and rigidly connecting together the first and second column sections.

* * * * *